United States Patent [19]

Mitts et al.

[11] Patent Number: 4,688,686

[45] Date of Patent: Aug. 25, 1987

[54] VERTICALLY ADJUSTABLE ROTARY SHELF ASSEMBLY

[75] Inventors: Richard K. Mitts, Fullerton, Calif.; J. Kevin Jones, Jeffersontown, Ky.

[73] Assignee: Rev-A-Shelf, Inc., Jeffersontown, Ky.

[21] Appl. No.: 847,182

[22] Filed: Apr. 2, 1986

[51] Int. Cl.[4] ..... A47F 5/00

[52] U.S. Cl. ..... 211/183; 312/305

[58] Field of Search ..... 211/144, 129, 13, 95, 211/163, 166, 78, 131, 183, 207; 248/188.4, 188.5, 354.1, 354.3, 354.4, 415, 425; 312/305, 118; 403/6, 78, 354, 362

[56] References Cited

U.S. PATENT DOCUMENTS

| | | | |
|---|---|---|---|
| 1,344,092 | 6/1920 | Shaw | 248/415 X |
| 2,024,416 | 12/1935 | Limerick, Jr. | 312/305 |
| 2,325,526 | 7/1943 | Major | 403/7 X |
| 2,527,132 | 10/1950 | Jackson et al. | 211/144 X |
| 2,684,222 | 7/1954 | Miller | 248/354.3 X |
| 2,831,582 | 4/1958 | Cody | 312/305 X |
| 3,127,994 | 4/1964 | Campbell | 267/41 X |
| 4,111,217 | 9/1978 | Victor | 248/188.4 X |
| 4,181,037 | 1/1980 | Boon | 312/305 X |
| 4,228,745 | 10/1980 | Gale | 248/188.4 X |
| 4,418,970 | 12/1983 | Hyden | 312/305 |
| 4,433,885 | 2/1984 | Baker | 312/305 |

*Primary Examiner*—Ramon S. Britts
*Assistant Examiner*—Sarah A. Lechok Eley
*Attorney, Agent, or Firm*—Scott R. Cox

[57] ABSTRACT

A rotary shelf assembly having shelves mounted on a vertical post is connected to a cabinet frame by upper and lower mounting brackets interacting with bearing members to support the post. The assembly is adapted to be mounted in the corner of the cabinet frame. To adjust the vertical position of the cabinet frame, the lower bearing element is adjustable by means of a threaded shaft which raises and lowers the vertical post. The threaded shaft is raised and lowered by means of either a knurled cylindrical element or a toothed cylindrical element, accessible through the post by rectangular openings. By rotating the toothed or knurled elements, the shaft of the vertical adjustment means rotates within the mounting bracket, thereby adjusting the height of the rotary shelf assembly.

13 Claims, 7 Drawing Figures

VERTICALLY ADJUSTABLE ROTARY SHELF ASSEMBLY

BACKGROUND OF INVENTION

1. Field of the Invention

This invention relates to a rotary shelf assembly. In particular it comprises an adjustable rotary post assembly supporting a plurality of shelves.

2. Prior Art

It has been common in the past to provide in corner kitchen cabinets, shelves of a rotatable or "Lazy Susan" type. Such shelves have become popular because, without them, much cabinet space in the corner, either above or below the kitchen counter, is wasted due to the inaccessibility of items well back in the corner.

Basically, rotatable corner shelf units have taken either of two forms: units in which a tubular element forms a vertical rotatable axis attached to the shelves, or units in which the cabinet door has formed the vertical member and means for attaching the door to the cabinet have been provided adjacent to the upper and lower shelves.

One of the problems encountered with prior assemblies is the difficulty of aligning the doors and the shelves relative to the cabinet frame which houses the assembly. Slight variances in height of the assembly can frequently occur as a result of shipping or installation. Further, after extended usage, the loading bearing base for the assembly frequently becomes depressed also necessitating adjustments to the height of the assembly. Accordingly, a means for adjusting the height of the assembly after installation is quite important.

Various vertical adjustment devices have been provided to align the shelf mechanism within the cabinet. One such mechanism was disclosed in U.S. Pat. No. 3,127,994 in which a telescoping vertical shaft was used. In addition, U.S. Pat. No. 4,433,885 discloses a wedge mechanism, located below the shaft of the shelf assembly, for making a vertical adjustment to the shelf assembly. Insertion or retraction of the wedge will raise and lower the shaft of the shelf mechanism.

U.S. Pat. No. 4,486,107 discloses a vertical adjustment mechanism whereby adjustment is accomplished by a screw and cam block system. A horizontal screw projecting through the support shaft moves a cam block which raises or lowers the shelf assembly.

However, either a sliding wedge system or a cam block assembly can become scored through use or clogged with dust, dirt or other particulate matter necessarily present in a kitchen cabinet. Such difficulties will make the assemblies hard to adjust.

Further, correction of a vertical misalignment or the prior art assemblies frequently requires partial disassembly of the shelf assembly. This disassembly often necessitates removal of all or most of the stored goods and removal of one or more of the shelves. All of these adjustments are troublesome, time consuming, and sometimes laborious.

In addition, the prior art means for adjusting the height of a shelf assembly require the use of tools. Frequently the prior art adjusting mechanism were not easily accessible for adjustment.

Accordingly, it is an object of this invention to provide a rotary shelf assembly wherein the vertical height of the shelf assembly can be easily adjusted.

A further object of the invention is to provide a novel hand-adjustable mechanism for adjusting the vertical height of the support means.

Another object of the invention is to provide a rotary shelf assembly mechanism for use in corner areas of kitchen cabinets primarily known as "Lazy Susans", wherein the height can be adjusted to fit the needs of the space.

Other objects and features of the present invention will become apparent from a consideration of the following description which provides, with reference to the accompanying drawings depicting a selected example of construction, an illustration of the invention.

SUMMARY OF INVENTION

The instant invention is a means for adjusting the height of a rotary shelf assembly. The adjusting means comprises a method for raising and lowering the vertical post to which the shelves of the rotary shelf assembly are attached. The adjusting means basically comprises a shaft containing a friction means for rotating the shaft. By rotation of the shaft of the adjusting means, the rotary shelf assembly can be vertically adjusted. The adjusting means is contained partially within and partially below the post of the shelf assembly.

BRIEF DESCRIPTION OF THE DRAWINGS

The invention will not be described with reference to the accompanying drawings in which.

DETAILED DESCRIPTION OF THE PREFERRED EMBODIMENT

Figure 1:
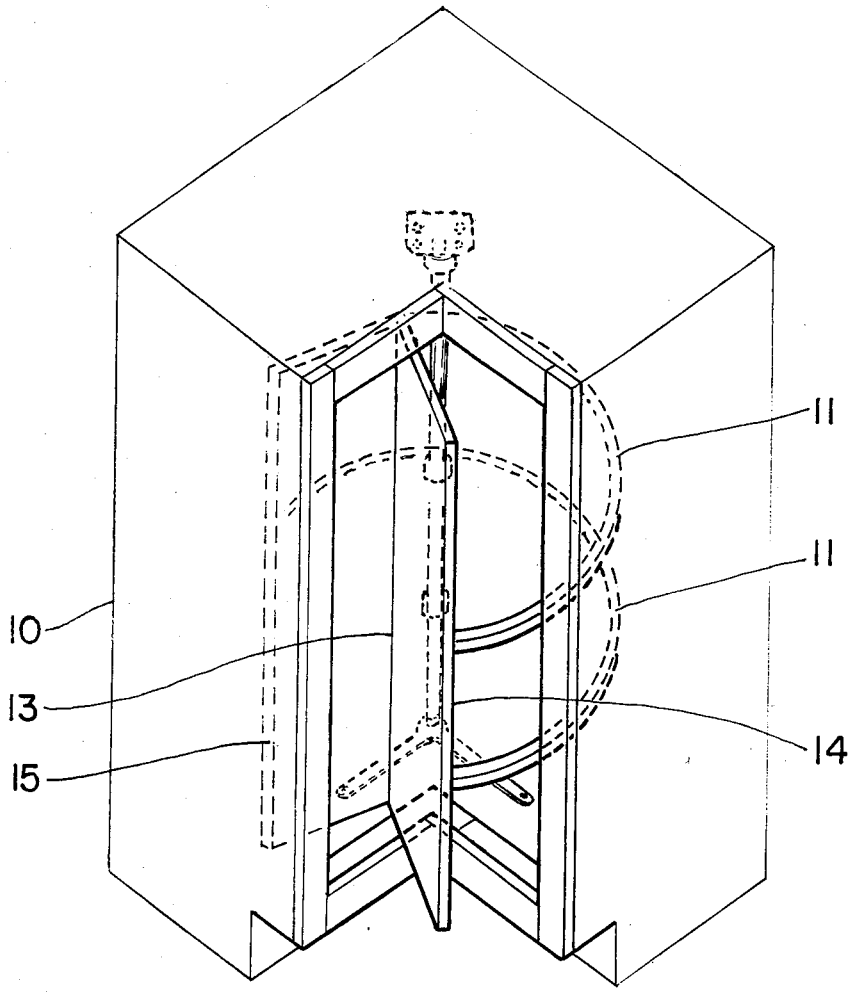
FIG. 1 is a perspective view of a cabinet unit including a rotary shelf assembly mechanism with a post height adjustment mechanism.

Although the invention is applicable to a wide variety of applications, it is shown in the drawings for purposes of illustration as embodied in an assembly including a hollow tubular vertical post (30) rotatable about its longitudinal axis and supporting one or more shelves (11) in the frame of a cabinet (10). The shelf assembly is mounted in a corner cabinet (10). The door (13) associated with the assembly is V-shaped so that each half (14 and 15) aligns with one of the outside walls of the cabinet when the door is closed. Each shelf is circular except for a pie-shaped sector which has perpendicular edges (16) to accommodate the door. The shelf is centered about the axis of the post (30). Such a cabinet (10) can be positioned above or below a kitchen or bathroom counter top and serves to store items within the cabinet in locations which are usually inaccessible.

Figure 2:
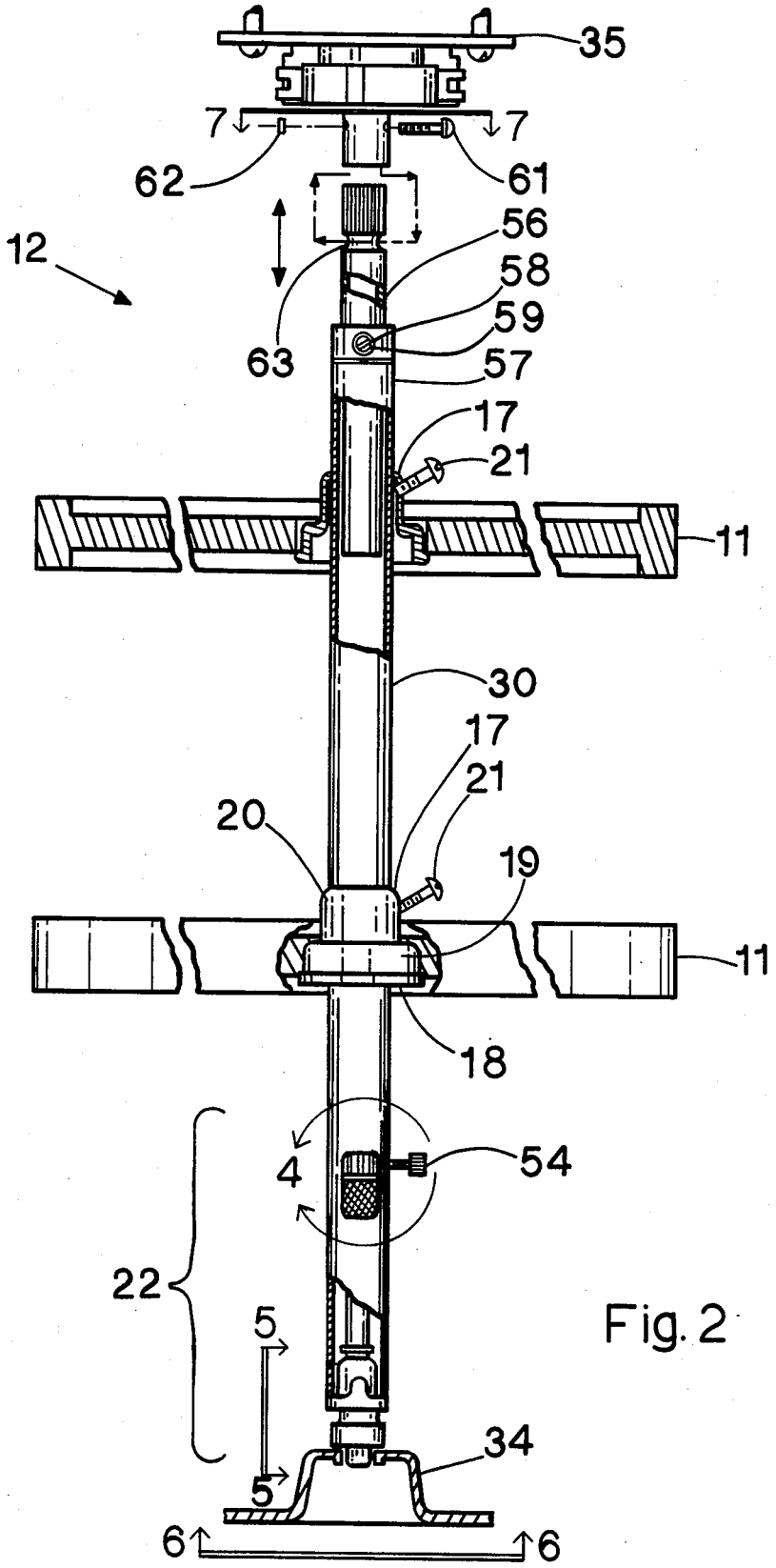
FIG. 2 is a cross-sectional side view of the rotary shelf assembly.

Referring to FIG. 2, the rotary shelf assembly (12) includes the post (30), the collar or collars (17) for mounting the shelves, the post height adjustment mechanism (22) the rotary catch mechanism (23) and upper and lower mounting brackets (34, 35).

The shelf or shelves (11) are mounted to the post by means of a collar (17) which encircles the post (30). As shown in FIG. 2, the collar (17) includes a mounting plate (18) and two cylindrical sections (19, 20). The mounting plate (18) is larger in diameter than either cylindrical section (19, 20). The upper cylindrical section (20) has a smaller diameter than the lower cylindrical section (19). The collar is fastened at the desired location on the post by a collar locking screw (21) threaded through the collar and bearing against the post. The inner edge of the shelf (11) rests on the mounting plate (18) and is supported by the upper and lower cylindrical section (19, 20). The shelves are secured to the collar by any conventional means. In the preferred embodiment, the lower cylindrical section of the collar (19) has inserts which match with notches present in the shelf (11). The shelves (11) rest on the mounting plate (18) and are prevented from rotating by the insert and notch arrangement of the lower cylindrical section (19) and the shelf. The shelf may also be secured by screws or other fasteners running through the shelf (11) and attached to the collar (17).

Figure 3:
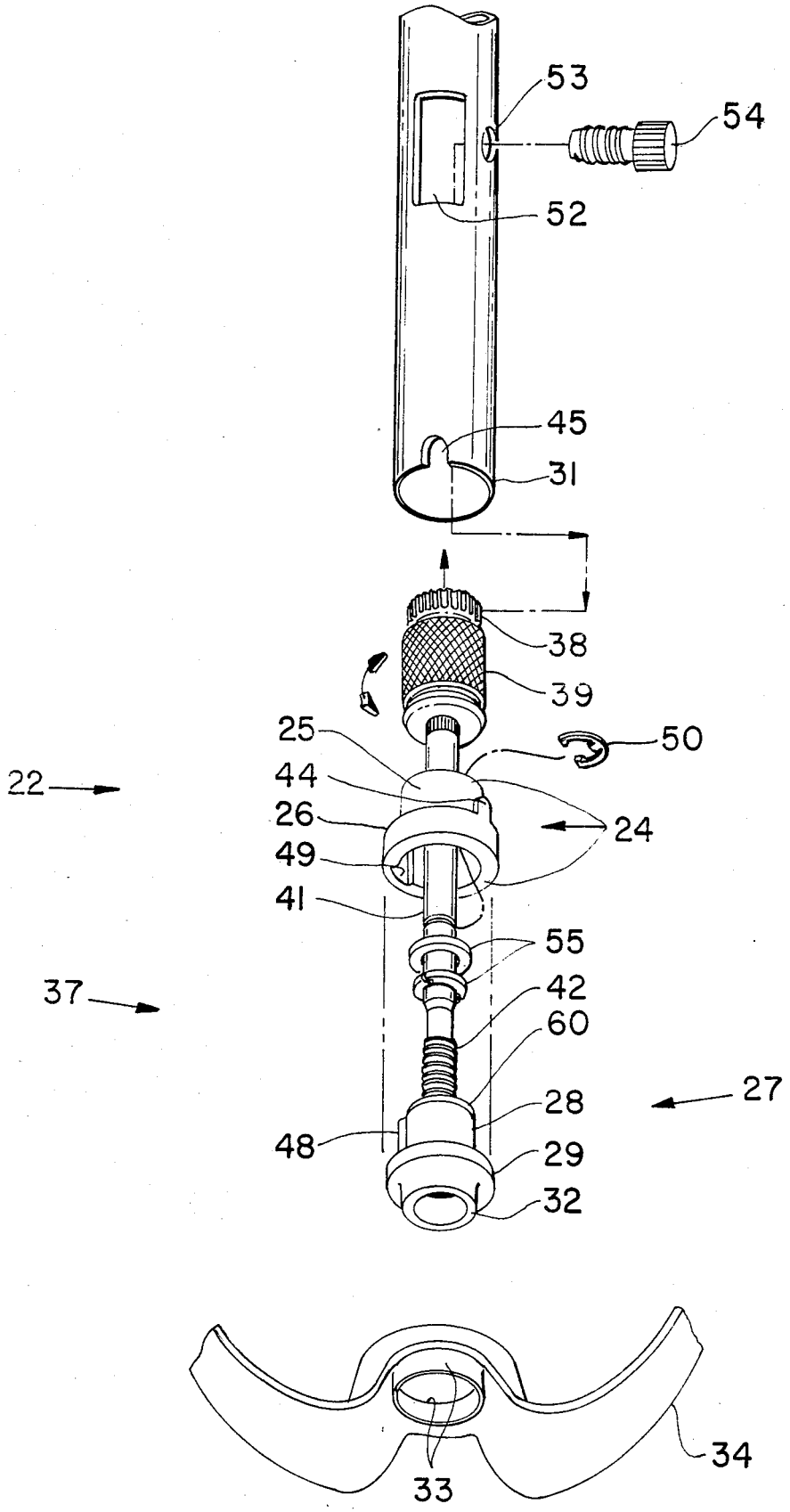
FIG. 3 is an exploded view of the post height adjustment mechanism.
Figure 4:
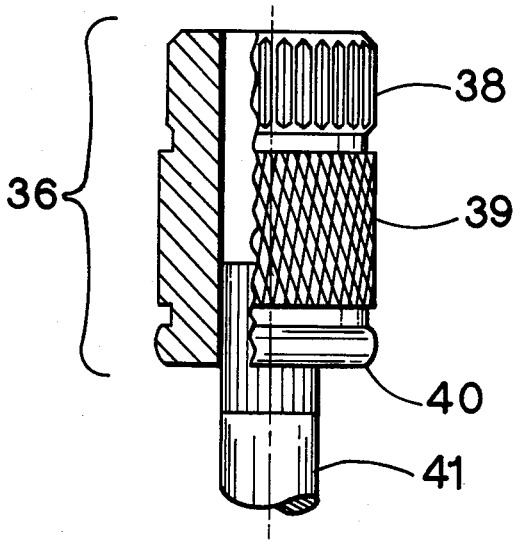
FIG. 4 is a sectional view of the upper portion of the post height adjustment mechanism.

Referring to FIG. 3, the bottom lip of the post (31) fits over an upper cylindrical section (25) of a collar (24) of the post height adjustment mechanism (22), and rests on the upper lip of a lower cylindrical section (26) of that collar (24). The collar (24) will be described in more detail later.

A bottom bearing (27) of the post height adjustment mechanism (22) is received within a socket (33) of a lower mounting bracket (34) (See FIG. 2). The lower mounting bracket can be secured to the floor of the cabinet (10) by any conventional fasteners. The bottom bearing (27) serves as an adapter between the post (30) and the socket (33) in the lower mounting bracket (34) and provides for a low friction rotation means for the post (30).

Figure 7:
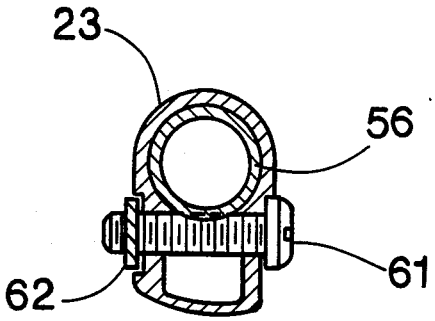
FIG. 7 is a view showing the securing of the rotary catch mechanism to the top of the post.

The upper portion of the post (56) is received within a rotary catch mechanism (23). See FIG. 2. The rotary catch mechanism (23) is secured to the upper portion of the post (56) by slightly recessing the post (63) where it comes in contact with a securing bolt (61) (See FIGS. 1 and 7). To prevent loosening of the securing bolt (61), the nut (62), attached to the securing bolt, may be elongated. The rotary catch mechanism (23) engages an upper mounting bracket (35). The upper mounting bracket (35) is secured to the ceiling of the cabinet (10) with conventional fasteners and provides an upper support for the post (30). The rotary catch mechanism (23) serves as a means for stopping and aligning the rotary position of the door panels (14 and 15) with respect to the cabinet (10). The catch mechanism (23) holds the post (30 and the cabinet (10) in a closed position by means of a detent mechanism or other such mechanism commonly known in the industry.

The height adjustment mechanism (22) depicted in FIGS. 2, 3, 4 and 5 serves as a means for adjusting the vertical position of the post (30) relative to the cabinet (10). The height adjustment mechanism (22) is positioned partially within and partially below the post (30). The adjustment mechanism (22) includes an upper section (36) (See FIG. 4) and a lower section (37) (See FIG. 5).

The upper section (36) comprises an upper straight-toothed cylindrical segment (38), a lower diamond-toothed knurled cylindrical segment (39) and a metal bearing (40) connected to a shaft (41) which extends between the upper section (36) and the lower section (37) of the post height adjustment mechanism (22). The upper section (36) can be secured to the shaft (41) by any conventional method such as welding or merely driving the shaft into an opening in the upper section.

The lower section (37) (See FIG. 5) of the adjustment mechanism (22) includes the lower section of the shaft (41) which is smaller in diameter than the upper portion of the shaft (41) and is threaded (42), a collar (24) surrounding a portion of the shaft, certain securing means such as washers or c-rings (50 and 55) to limit the vertical movement of the collar (24) and a means (60) for rotating the bottom bearing element (27) around the threaded shaft (42). The means (60) for rotating the bottom bearing can be a threaded nut to which the bottom bearing (27) is secured. In a preferred embodiment the rotation nut (60) is coated with a Teflon-like substance to provide for easy rotation of the bottom bearing (27). The bottom bearing (27) is attached to the rotation nut (60) by any conventional means such as welding or securing by adhesives. By rotating the threaded portion of the shaft (42), the bottom bearing (27) will rise or descent depending on the direction of rotation of the threaded shaft (42). The bottom bearing element (27) is prevented from rotating off the threaded portion of the shaft (42) by any conventional method such as enlarging the end of the threaded portion of the shaft (42) to a greater diameter than the inner diameter of the rotation nut (60).

The bottom bearing (27) is comprised of three elements. See FIG. 5. A lower cylindrical element (32) of the bottom bearing (27) is a cylindrical surface which rotates within the socket (33) of the lower mounting bracket (34). See FIGS. 3 and 6. The lower cylindrical element (32) rests within the socket (33) and rotates freely about the axis of the post (30). Above the lower cylindrical element (32) of the bottom bearing (27) is a middle cylindrical element (29) larger in diameter than either the lower cylindrical element (32) or the socket (33) of the lower mounting bracket (34). The lower surface of the middle cylindrical element (29) rests on the top surface of the lower mounting bracket (34). An upper cylindrical element (28) of the bottom bearing element (27) which is above the middle cylindrical element (29) is narrower in diameter than the middle cylindrical element. It is narrow enought to fit within a collar (24) which will be discussed in the following paragraph.

Between the upper section (36) of the height adjustment mechanism (22) and the bottom bearing (27) and fitting over the shaft (41) is a notched and slotted collar (24) (See FIG. 3). The collar (24) has an upper cylindrical section (25) which fits inside the post (30) except for an outward notch (44). The outward notch (44) fits in a slit (45) in the bottom of the post (30) to prevent rotation of the post (30) around the axis of the post (30) unless the collar (24) itself rotates. The collar (24) has a lower cylindrical section (26) which is larger in diameter than the upper section (25). The lower lip (31) of the post rests on the upper lip of the lower cylindrical section (26) of the collar (24).

Figure 5:
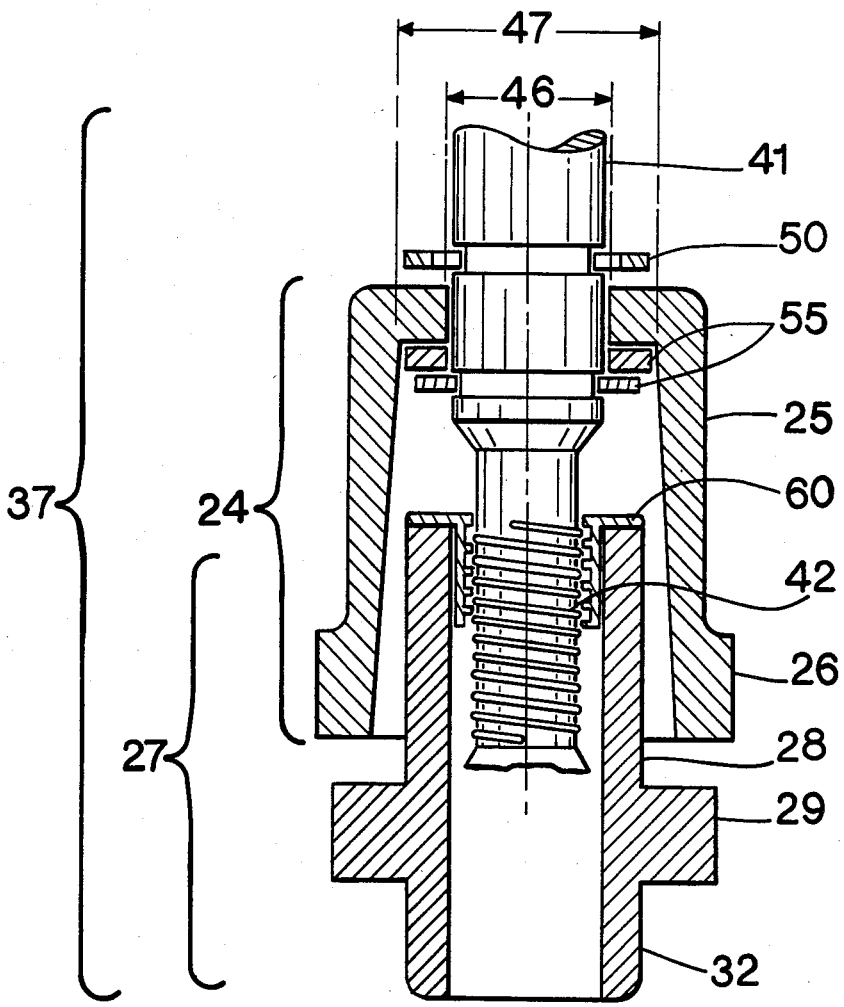
FIG. 5 is a sectional view of the lower portion of the post height adjustment mechanism.
Figure 6:
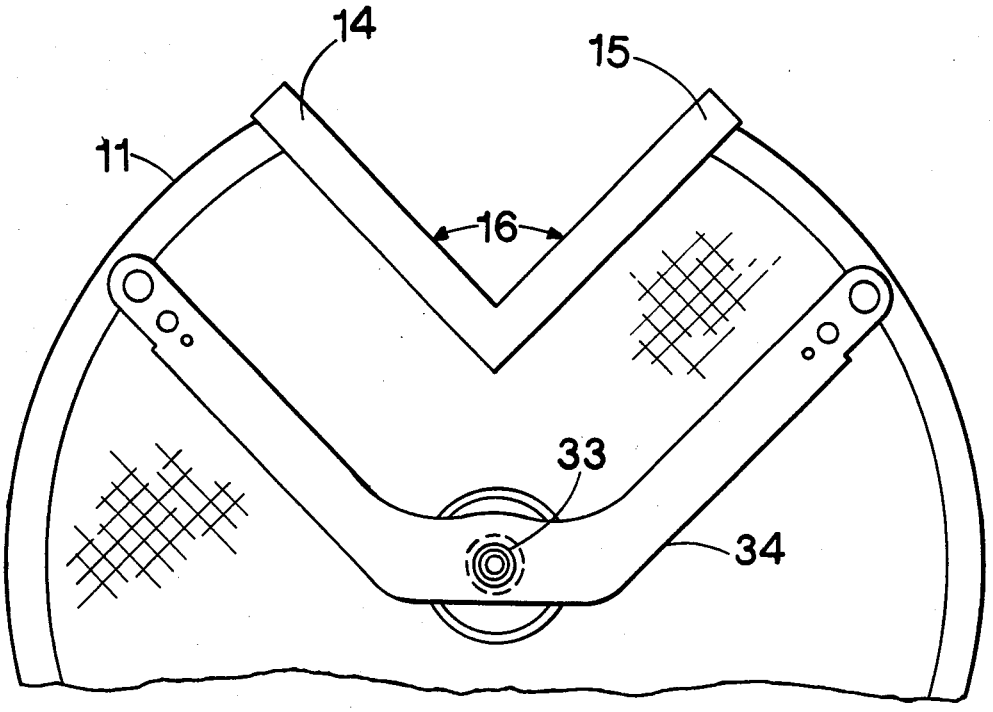
FIG. 6 is a bottom view of the lower mounting bracket.

The collar (24) also has an interior upper (46) and lower diameter (47) (See FIG. 5). The lower interior diameter (47) is sufficiently wide to fit over the upper cylindrical element (28) of the bottom bearing (27). The upper cylindrical element (28) of the bottom bearing (27) has a notch (48) running the length of the vertical axis of the upper cylindrical element (28) (See Fig. 3). The lower inner surface of the collar (24) has a slit (49)

the same size or slightly larger than the notch (48) of the upper cylindrical element (28) which allows the collar (24) to fit over the upper cylindrical element (28). This slit and notch arrangement prevents the rotation of the collar (24) about the axis of the shaft (41). The upper interior diameter (46) of the collar is slightly larger than the diameter of the shaft (41) allowing the collar (24) to freely rotate about the axis of the shaft (41). Secured to the shaft (41) by any conventional method directly above the threaded portion of the shaft (42) are one or more washers (55). This washer (55) or washers limit the downward vertical movement of the collar (24) along the shaft (41). The washer (55) is of sufficient diameter to support the sleeve (24). The washer (55) is of a lesser diameter than the lower interior diameter (47) of the collar but of greater diameter than the upper inner diameter (46) of the collar. Located above the collar (24) and secured to the shaft (41) is a means (50) for preventing the collar (24) from upward vertical movement along the shaft (42). This means can be any conventional means for preventing such vertical movement including washers or c-rings secured to the shaft (41).

By this combination of washers or c-rings secured to the shaft both below (55) and above (50) the collar (24), the collar (24) is limited in movement along the axis of the shaft (41) as defined by the distance between these washers.

As the post height adjustment mechanism (22) is rotated, the threaded shaft (41) turns the rotation nut (60) within the lower bearing (27) resulting in the lower bearing (27) moving vertically along the shaft (41). The collar (24) resting on the washer (55) will not rotate as the adjustment mechanism (22) is rotated. However, as the bottom bearing (27) moves vertically along the axis of the shaft, the distance between the lower surface (26) of the lower section of the collar and the middle cylindrical element (29) of the bottom bearing (27) will change. Accordingly as this distance increases the post (30) and the cabinet assembly (12) will rise.

Access to the straight-toothed cylindrical segment (38) and the lower diamond-toothed knurled segment (39) of the height adjustment mechanism (22) is provided through the hollow post (30) by means of two rectangular openings (52) on opposite sides of the hollow post (30). The size of the openings (52) are sufficient to allow access to the toothed segments (38 and 39) for manual adjustment. If not secured, these two segments (38 and 39) rotate freely within the post (30) around the axis of the post (30) sufficiently close to the openings (52) to allow easy rotation of the toothed segments (38 and 39) for manual adjustment. The metal bearing (40) is slightly larger in diameter than either the straight-toothed cylindrical segment (38) or the diamond-toothed knurled segment (39). The metal bearing provides a low friction drag to the post height adjustment mechanism (22) and prevents either of the toothed knurled segments (38 and 39) from contacting the inner surface of the tubular post (30).

With the openings (52) in the hollow tubular vertical post (30) giving access to the post height adjustment mechanism (22), rotation of the adjustment mechanism (22) is possible by manual rotation of the lower cylindrical diamond knurled segment (39) or by rotating the straight toothed segment (38) by hand or by use of a tool.

A locking screw hole (53) is located at the same height in the hollow tubular vertical post (30) as are the rectangular openings (52). A locking screw (54) fits in the locking screw hole (53) which is located between the rectangular openings and can be tightened against the upper toothed segment (38) of the post height adjustment mechanism (22). The locking screw (54) can be of any conventional type, including one having knurled sides so that it can be adjusted by hand. Conventional screws may also be used which may be tightened by a screwdriver. By securing the locking screw (54) against the upper toothed segment (38) of the post height adjustment mechanism (22), movement of the post height adjustment mechanism (22) will be restricted. When the movement is restricted, the hollow tubular vertical post (30) and the attached shelves (11) will be maintained at the established height.

For large adjustments to the height of the vertical post (30), an upper section (56) and a lower section (57) of the shaft may be provided. The upper section (56) has an outer diameter less than the inner diameter of the lower section (57) such that the upper section (56) slides freely within the lower section (57) and can telescope out from the lower section to provide additional height. A second locking screw hole (58) is located near the top of the lower section (57) (See FIG. 2). A second locking screw (59) fits into this hole (58) and can be tightened to secure the upper section (56) of the post at a convenient height. Any conventional type of screw can be used. This arrangement allows for large variations in the height of the rotary shelf assembly (12) within the cabinet (10). For precise adjustments to the height of the rotary shelf assembly (12), however, the post height adjustment mechanism (22) should be used as previously disclosed.

With the foregoing arrangement, the shelf assembly is installed by first securing an upper mounting bracket to the cabinet and aligning the vertical post within the rotary catch mechanism to the upper mounting bracket. Attached to the hollow tubular vertical post are the shelves which are adjusted to any height desired. The vertical post is secured to the bottom portion of the cabinet by securing the lower mounting bracket to the bottom of the cabinet and adjusting the height of the post by telescoping the upper section of the post so that the shelf assembly is secured within the cabinet.

The post height adjustment mechanism is usually adjusted to its mid-range when inserted. Major adjustments to the shelf assembly can be made by adjusting the upper and lower sections of the post. At that time the locking screw is loosened and the post height adjustment mechanism is rotated until the lower bearing element rests within the socket of the lower mounting bracket to allow for free movement. The knurled and toothed sections of the height adjustment mechanism are then rotated until the shelf assembly fits comfortably and easily within the upper and lower mounting brackets. At this time the screw is locked against the upper cylindrical toothed section of the post height adjustment mechanism to prevent further unintentional adjustments.

In operation, an individual wishing to adjust the height of the "Lazy Susan" assembly loosens the screw which restricts the movement of the post height adjusting mechanism. The height adjusting mechanism is then rotated by manual adjustment to the knurled cylindrical section through the openings in the post. Alternatively, the toothed cylinder section is rotated either manually or by use of a flat instrument, such as a screwdriver. This toothed section is also accessible through the openings in the post. Rotation of either of these cylindrical elements results in the threaded portion of the shaft of the adjusting mechanism rotating through the bearing element for the shelf assembly. By this rotation, the shelf assembly is raised or lowered. Once the correct height for the shelf assembly is obtained, the set screw is secured against the adjusting mechanism to prevent further rotation. By this method, adjustments are made in the height of the rotatable shelf assembly.

I claim:

1. A rotary shelf assembly mechanism, said mechanism comprising:

(a) first and second mounting brackets spaced apart and opposing each other;

(b) a tubular post disposed lengthwise between the first and second mounting brackets supporting one or more shelves;

(c) a first bearing element mounted on the post adjacent to a first end of the post and capable of engaging the first mounting bracket for rotation about the axis of the post; and (d) a threaded height adjustment means which is entirely enclosed within the tubular post and which is accessible through an opening in the tubular post and and which is located above a second bearing element operable to engage the second mounting bracket.

2. The rotary shelf assembly of claim 1 wherein the threaded height adjustment means is adjustable by rotating the threaded height adjustment means, which is positioned within the tubular post and above the second bearing element, about the axis of the post.

3. The rotary shelf assembly of claim 1 wherein the threaded height adjustment means includes a knurled member connected by a threaded shaft to the second bearing element.

4. The rotary shelf assembly of claim 1 where the threaded height adjustment means includes a toothed cylindrical member connected to a knurled cylindrical member, both of which are connected by a shaft to the second bearing element.

5. The rotary shelf assembly of claim 4 wherein the toothed cylindrical member and the knurled cylindrical member can be rotated together within the tubular post by manual adjustment through an opening in the tubular post.

6. The rotary shelf assembly of claim 3 wherein the threaded height adjustment means includes a cylindrical collar surrounding the shaft of the threaded height adjustment means wherein the cylindrical collar supports the tubular post.

7. The rotary shelf assembly of claim 6 wherein the cylindrical collar contains an upper cylindrical element and a lower cylindrical element wherein the upper cylindrical element fits within the tubular post and the lower cylindrical element supports a lip of the tubular post.

8. The rotary shelf assembly of claim 6 wherein the cylindrical collar is limited in rotation about the axis of the tubular post by the interaction between the notch in the cylindrical collar and a slit in the tubular post.

9. The rotary shelf assembly of claim 6 wherein the cylindrical collar is restricted in vertical movement by a movement restricting means.

10. The rotary shelf assembly of claim 3 wherein the movement restriction means comprises washers secured to the shaft of the threaded height adjustment means.

11. The rotary shelf assembly of claim 1 wherein the first bearing element is secured to the tubular post by the combination of an indented section of said tubular post and a securing bolt.

12. A rotary shelf assembly mechanism, said mechanism comprising:

(a) first and second mounting brackets spaced apart and opposing each other;

(b) a tubular post disposed lengthwise between the first and second mounting brackets supporting one or more shelves;

(c) a first bearing element secured to the post adjacent to the first end of the post by a securing bolt which is capable of engaging the first mounting bracket for rotation about the axis of the post; and (d) a second bearing element secured to a threaded height adjustment means by a bolt and being capable of engaging the second mounting bracket, the threaded height adjustment means comprising a knurled cylindrical member and a toothed cylindrical member; an opening in the post through which the knurled and toothed cylindrical members are accessible for manual adjustment; and knurled and toothed cylindrical members connected to a threaded shaft, wherein the threads run through the second bearing member; a notched cylindrical collar surrounding the shaft of the threaded adjusting means, wherein the notched cylindrical collar fits within the tubular post; wherein the tubular post is restricted from rotation by said notch on the cylindrical collar; wherein the post rests on a lip of a cylindrical portion of the collar; and wherein the collar is restricted from vertical movement by a restricting means connected to the threaded shaft.

13. The rotary shelf assembly of claim 1 wherein the threaded height adjustment means include an upper section and a threaded lower section.

* * * * *